US007077045B2

(12) United States Patent
Dietrich et al.

(10) Patent No.: US 7,077,045 B2
(45) Date of Patent: Jul. 18, 2006

(54) PROJECTILE INDUCTIVE INTERFACE FOR THE CONCURRENT TRANSFER OF DATA AND POWER

(75) Inventors: Mark Charles Dietrich, Tucson, AZ (US); Eric Christopher Maugans, Tucson, AZ (US)

(73) Assignee: Raytheon Company, Waltham, MA (US)

( * ) Notice: Subject to any disclaimer, the term of this patent is extended or adjusted under 35 U.S.C. 154(b) by 136 days.

(21) Appl. No.: 10/670,044

(22) Filed: Sep. 24, 2003

(65) Prior Publication Data

US 2005/0061191 A1 Mar. 24, 2005

(51) Int. Cl.
*F42C 17/04* (2006.01)

(52) U.S. Cl. ..... 89/6; 102/215; 102/206

(58) Field of Classification Search ..... 89/6, 89/6.5; 102/207, 209, 206, 215
See application file for complete search history.

(56) References Cited

U.S. PATENT DOCUMENTS

| | | | | |
|---|---|---|---|---|
| 4,273,051 | A | 6/1981 | Stratton | |
| 4,644,864 | A | 2/1987 | Komorowski et al. | |
| 5,101,728 | A | 4/1992 | Frink | |
| 5,117,732 | A | 6/1992 | Munzel et al. | |
| 5,343,795 | A | 9/1994 | Ziemba et al. | |
| 5,497,704 | A * | 3/1996 | Kurschner et al. | 102/264 |
| 6,170,377 | B1 | 1/2001 | Larsson et al. | |
| 6,176,168 | B1 | 1/2001 | Keil et al. | |
| 6,268,785 | B1 | 7/2001 | Kollman et al. | |
| 6,557,450 | B1 * | 5/2003 | Cox et al. | 89/6.5 |
| 6,675,715 | B1 * | 1/2004 | Kolbli | 102/206 |

FOREIGN PATENT DOCUMENTS

| | | |
|---|---|---|
| DE | 38 27 374 C1 | 7/1994 |
| DE | 197 56 357 A1 | 6/1999 |

OTHER PUBLICATIONS

International Search Report for corresponding Application No. PCT/US2004/028716 mailed Oct. 4, 2005.

* cited by examiner

*Primary Examiner*—Michael J. Carone
*Assistant Examiner*—James S Bergin
(74) *Attorney, Agent, or Firm*—Renner, Otto, Boisselle & Sklar, LLP

(57) ABSTRACT

A projectile includes a body, a payload within the body, a target system within the body for affecting operation of the projectile, and an inductive interface which, as part of the target system, permits transfer of at least one of power and data between the target system and an external setter system. The inductive interface includes a magnetic core comprised of a compound of ferrite material and non-ferrite material and a coil wrapped around the magnetic core.

17 Claims, 10 Drawing Sheets

PROJECTILE INDUCTIVE INTERFACE FOR THE CONCURRENT TRANSFER OF DATA AND POWER

TECHNICAL FIELD

The present invention relates generally to projectiles. More specifically, the present invention relates to an inductive interface for transferring data and power to and/or from a projectile.

BACKGROUND OF THE INVENTION

Inductive fuze setters for projectiles are known in the art. Inductive fuze setters are used to transmit data to a projectile, such as time-of-flight data, time-to-burst data, target coordinates, etc., as is known in the art. It is very important to be able to quickly and reliably transmit data to a projectile as, for example, the projectile is moving from a magazine to a cannon. Moreover, it is important to be able to verify that the projectile has correctly received the transmitted data.

Typically, the projectile includes an internal coil for forming an inductive interface with an external setter device. The setter device includes a coil which, when placed in close proximity to the coil within the projectile, becomes inductively coupled to the projectile coil. The setter coil is excited and modulated to communicate data to the projectile. The projectile coil receives the data which can then be provided to appropriate electronic circuitry included within the projectile as is known. Conversely, the electronic circuitry within the projectile may excite and modulate the projectile coil and thereby inductively transmit data to the setter coil.

In order to improve inductive coupling between the setter coil and projectile coil, it has been known include a magnetic core within the projectile. The projectile coil is wound around the magnetic core in order to concentrate the magnetic flux and increase coupling. The magnetic core may be made of iron or typical ferrite core material. However, iron is relatively heavy and can thereby detract from the projectile capacity. Typical ferrite core material, on the other hand, may be slightly lighter in weight compared to iron. However, ferrite core material is typically very brittle, not easily machinable, and subject to cracking and/or otherwise losing its structural integrity during handling and/or use of the projectile. This can compromise the inductive coupling achievable with the setter coil, as well as possibly affect the aerodynamic or other characteristics of the projectile during or following launch. Furthermore, the shape of the magnetic core is oftentimes atypical due to space constraints, etc., within the projectile. As a result, machining of an iron or ferrite core can be both time consuming and expensive.

Also in the past, it has been known to include a separate set of coils, one in the setter device and one in the projectile, to provide power to the circuitry included within the projectile. This presented problems in that more volume was taken up within the projectile, and care was required to avoid coupling between the power coil and the data coil. Alternatively, power was provided within the projectile via a battery. However, battery life was limited and the cost of batteries contributed significantly to the cost of the projectile. There have been attempts to provide power and data to a projectile via a common coupling. (See, e.g., U.S. Pat. No. 4,644,864). However, such attempts met with only limited success.

In view of the aforementioned shortcomings associated with conventional inductive setters, there is a strong need in the art for an inductive interface which does not contribute significantly to the weight or cost of a projectile. Moreover, there is a strong need in the art for an inductive interface which is easily machinable and not likely to crack or otherwise lose its structural integrity prior to detonation. In addition, there is a strong need in the art for an improved way of communicating power and data between the setter device and projectile.

SUMMARY OF THE INVENTION

The present invention provides an inductive interface for a projectile. The interface includes a high-permeability magnetic core which maximizes power and data transfer while reducing the emission of electromagnetic radiation. This reduces interference with other electronics and reduces the probability of sensitive data being intercepted by a third party. Unlike conventional magnetic cores, the core is made of a relatively lightweight material with high impact strength, such as manganese-zinc or nickel-zinc ferrite filled plastic. The core does not tend to crack, etc., as do typical magnetic cores of scintered ferrite material or the like. Moreover, the core is lightweight compared to iron or conventional ferrite cores, thus providing significant weight savings. Furthermore, the core can be easily manufactured in complex shapes and sizes via molding, extrusion, machining, etc. This results in significantly lower manufacturing costs as will be appreciated.

Further, the inductive interface may include a single set of coils (setter coil and projectile coil (also referred to herein as a target coil). Data can be transferred into the projectile by bi-phase (e.g., Manchester) modulating the power waveform or time division multiplexing the power waveform with the data waveform (which may be modulated with any convenient modulation scheme).

According to one aspect of the invention, a projectile is provided. The projectile includes a body, a payload within the body, a target system within the body for affecting operation of the projectile, and an inductive interface which, as part of the target system, permits transfer of at least one of power and data between the target system and an external setter system. The inductive interface includes a magnetic core comprised of a compound of ferrite material and non-ferrite material and a coil wrapped around the magnetic core.

According to another aspect of the invention, a projectile is provided which includes a body, a payload within the body, a target system within the body for affecting operation of the projectile and an inductive interface which, as part of the target system, permits transfer of power and data between the target system and an external setter system. The inductive interface includes a same coil which serves to transfer power and data.

To the accomplishment of the foregoing and related ends, the invention, then, comprises the features hereinafter fully described and particularly pointed out in the claims. The following description and the annexed drawings set forth in detail certain illustrative embodiments of the invention. These embodiments are indicative, however, of but a few of the various ways in which the principles of the invention may be employed. Other objects, advantages and novel features of the invention will become apparent from the following detailed description of the invention when considered in conjunction with the drawings.

DETAILED DESCRIPTION OF THE INVENTION

Figure 1:
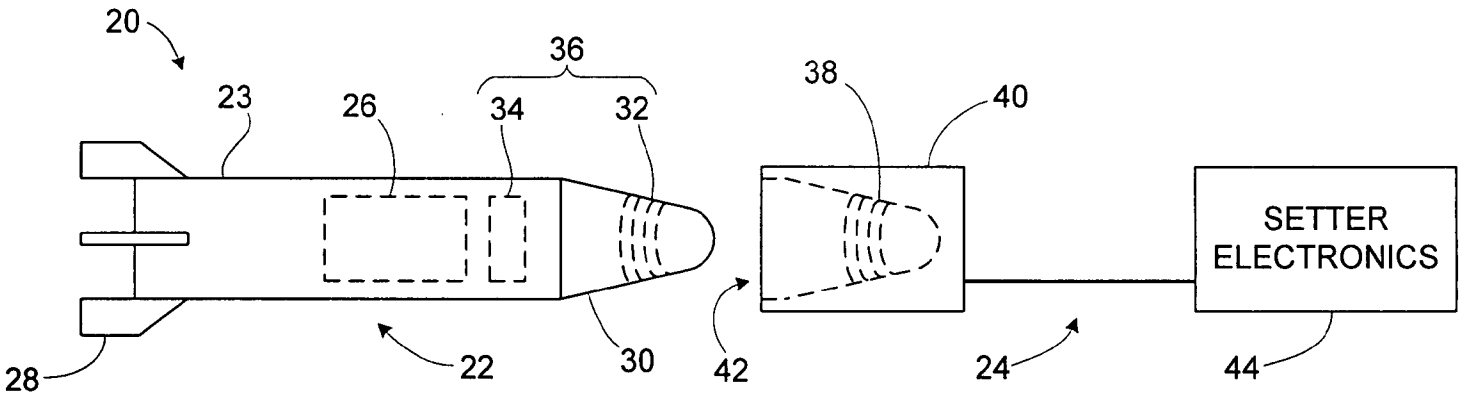
FIG. 1 is a bock diagram of an inductive fuze setter system incorporating an inductive interface for a projectile in accordance with an exemplary embodiment of the present invention.

The present invention will now be described with reference to the drawings, wherein like reference numerals are used to refer to like elements throughout.

Referring initially to FIG. 1, an inductive fuze setter system 20 is shown in accordance with an embodiment of the invention. The fuze setter system 20 includes a projectile 22 and an external setter system 24. As will be explained in more detail below, the fuze setter system 20 provides a means by which data, such as time-of-flight data, time-to-burst data, target coordinates, etc., or any other types of data which affect the operation of the projectile 22, can be exchanged between the setter system 24 and the projectile 22. In addition, the fuze setter system 22 provides a means by which power may be delivered to the projectile 22 in order to provide operational power within the projectile 22.

The projectile 22 may be any type of projectile including, but not limited to, artillery shells, missiles, rockets, bombs, torpedoes, etc. The projectile 22 may be powered or unpowered. Moreover, the projectile 22 may travel at any velocity such as subsonic, sonic or hypersonic, or a combination thereof. Furthermore, the projectile 22 may be single stage or multi-stage.

The projectile 22 includes a body 23, at least a portion of which is projected at time of launch. The body 23 is typically cylindrical, but is not limited to such a shape as will be appreciated. The body 23 may be a single integral unit, or part of a multi-stage or multi-component vehicle. For example, the body 24 may be a shell launched by artillery, or a multi-stage rocket in which portions of the body serve as a carrier vehicle for the warhead, etc. The present invention contemplates any and all such types of projectiles.

The projectile 22 further includes a payload 26 which is shown in phantom in FIG. 1. The payload 26 is carried in the body 23 and can be any conventional or non-conventional type of payload as will be appreciated by those having ordinary skill in the art. For example, the payload 26 may include explosives, conventional or nuclear warhead, guidance system, communication system, kill vehicle, satellite, etc. In the case where the projectile 22 is a kinetic energy weapon (KEW), the payload 26 may be the mass of the body 23 itself, for example.

In the exemplary embodiment, the projectile 22 includes aerodynamic fins 28. It will be appreciated, however, that such fins 28 are not necessary within the scope of the invention.

The exemplary projectile body 23 includes a nose portion 30 at the forward end of the body 23. In accordance with the exemplary embodiment, the projectile 22 includes a target coil 32 (shown in phantom) within the nose portion 30. It will be appreciated, however, that the target coil 32 could be located within a different portion of the body 23 without departing from the scope of the invention. The target coil 32 is electrically coupled to target electronics 34 (shown in phantom) within the body 23. The target coil 32 and target electronics 34 make up what is referred to herein as the target system 36 of the projectile 22. The target coil 32 provides a means by which the setter system 24 may be inductively coupled to the target electronics 34 to transfer data, such as time-of-flight data, time-to-burst data, target coordinates, etc., or any other types of data which affect the operation of the projectile 22. Moreover, power may be delivered to the projectile 22 in order to provide operational power within the projectile 22.

The setter system 24 includes a setter coil 38 (shown in phantom) located within a nose portion adapter 40. The nose portion adapter 40 is designed to engage the nose portion 30 of the projectile 22 in such a manner as to place the setter coil 38 in close proximity to the target coil 32 to allow for inductive coupling therebetween. In the exemplary embodiment, the nose portion adapter 40 includes a conical shaped cavity 42 into which the nose portion 30 is inserted to conduct data and/or power transfer. The setter coil 38, which is placed about the circumference of the cavity 42, is engaged in close proximity to the target coil 32, which is placed about the circumference of the nose portion 30.

The setter coil 38 is electrically coupled to the setter electronics 44 included as part of the setter system 24. The setter electronics 44 and the target electronics 32 are designed to communicate with each other via an inductive interface formed by the target coil 32 and the setter coil 38. The nose portion 30 is inserted into the nose portion adapter 40 and operational data and/or power is inductively coupled between the setter electronics 44 and the target electronics 34. As will be appreciated by those having ordinary skill in the art, the projectile 22 may thereafter be launched in accordance with the operational data and/or power thus provided.

Figure 2:
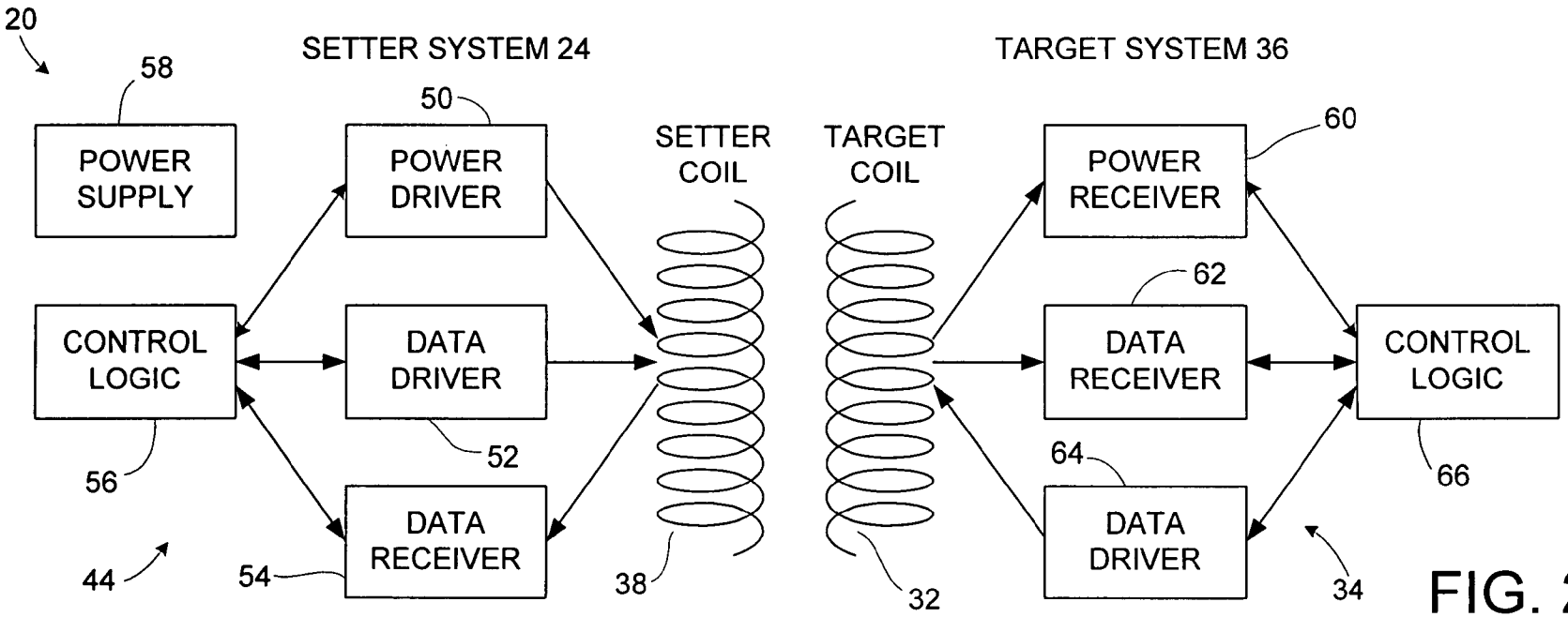
FIG. 2 is a detailed schematic block diagram of the inductive fuze setter system incorporating an inductive interface for a projectile in accordance with an exemplary embodiment of the present invention.

Turning now to FIG. 2, a detailed block diagram of the fuze setter system 20 is shown. The setter system 24 includes the setter electronics 44 and the setter coil 38. The setter electronics 44 includes a power driver 50 for delivering power to the target system 36 inductively via the setter coil 38. In addition, the setter electronics 44 includes a data driver 52 for providing operational data to the target system 36. Again, such data is provided inductively via the setter coil 38. Also included in the setter electronics 44 is a data receiver 54 for receiving data from the target system 36 in an embodiment in which the target system 36 communicates back to the setter system 24. For example, the target system 36 may transmit status information or data verification to the setter system 24. In another embodiment in which the target system 36 does not communicate back to the setter system 24, the data receiver 54 may be omitted as will be appreciated. The setter electronics 44 further includes control logic 56 for controlling the various operations within the setter system 24 as will be appreciated by those skilled in the art. Moreover, the setter electronics 44 includes a power supply 58 for providing operating power to the setter system 24 as will also be appreciated by those skilled in the art.

The target system 36 includes the target coil 32 and the target electronics 34. The target electronics 34 includes a power receiver 60 for receiving power inductively coupled from the power driver 50 via the target coil 32. In addition, the target electronics 34 includes a data receiver 62 for receiving data inductively coupled from the data driver 52 via the target coil 32. The target electronics 34 also includes a data driver 64 for providing response data to the setter system 24 via the target coil 32 in an embodiment which desires such data transfer. In another embodiment which does not require the target system 36 to communicate back to the setter system 24, the data driver 64 may be omitted as will be appreciated. The target system 36 further includes control logic 66 for controlling the operation within the target system 36 as will also be appreciated by those having ordinary skill in the art.

In the exemplary embodiment, the power driver 50 and power receiver 60 enable the setter system 24 to deliver operating power inductively to the target system 36. In an embodiment in which it is not necessary to provide power to the target system 24 (e.g., as a result of the target system 24 including a battery or alternative power supply), the power driver 50 and power receiver 60 may be omitted. Similarly, in an embodiment in which it is only necessary to transfer power to the target system 36, the data driver 52 and data receiver 62 may be omitted as will be appreciated.

Further, in the exemplary embodiment the setter system 24 and the target system 36 each include only a single coil 38 and 32, respectively. In another embodiment in which it is not preferable to utilize a single coil in each respective system, multiple coils may be utilized. For example, the setter system 24 and target system 36 may each include a pair of coils, one coil used for transferring data and another coil used for transferring power.

Figure 3:
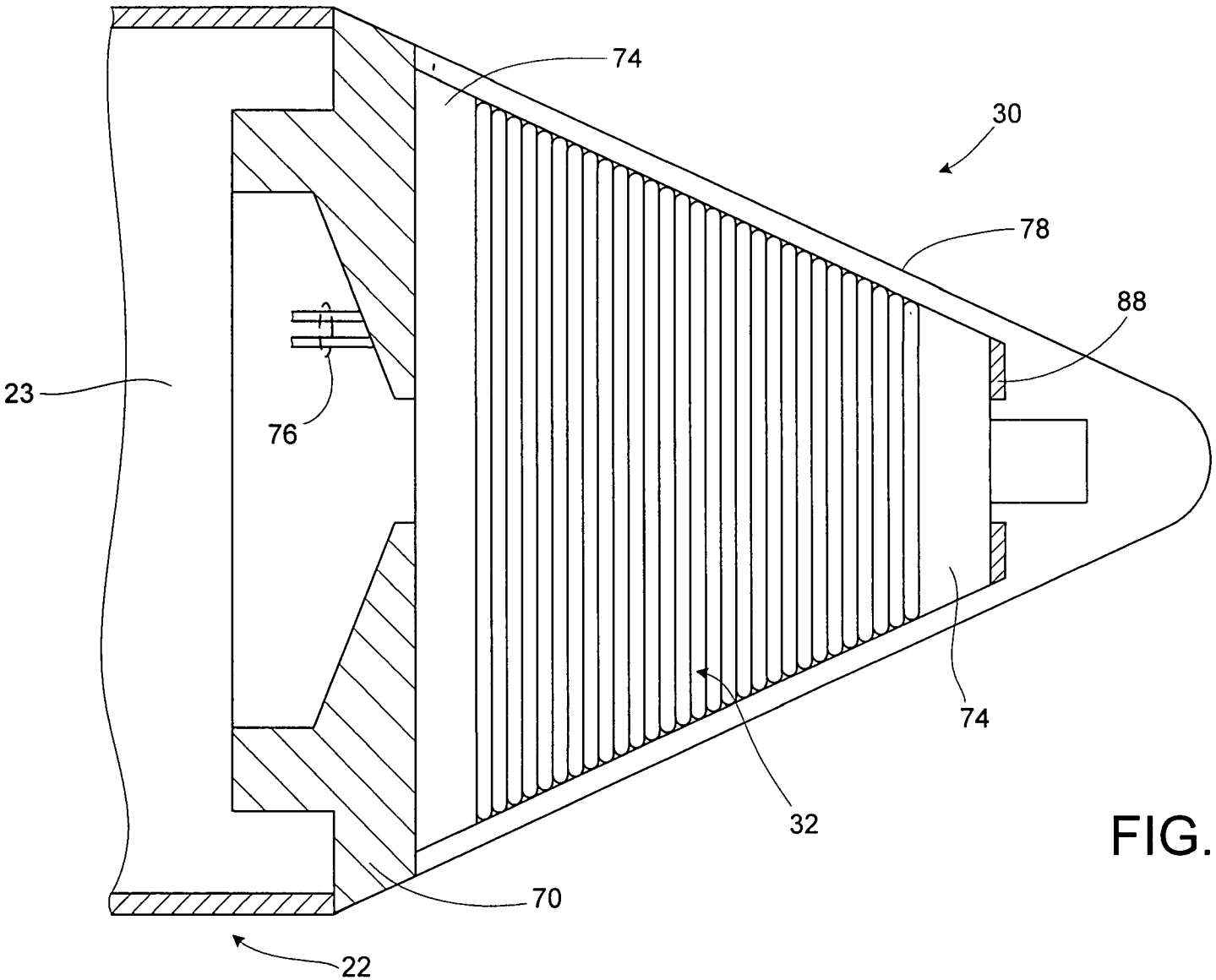
FIG. 3 is a partial cross-sectional drawing of a relevant portion of a projectile including an inductive interface in accordance with an exemplary embodiment of the present invention.
Figure 4:
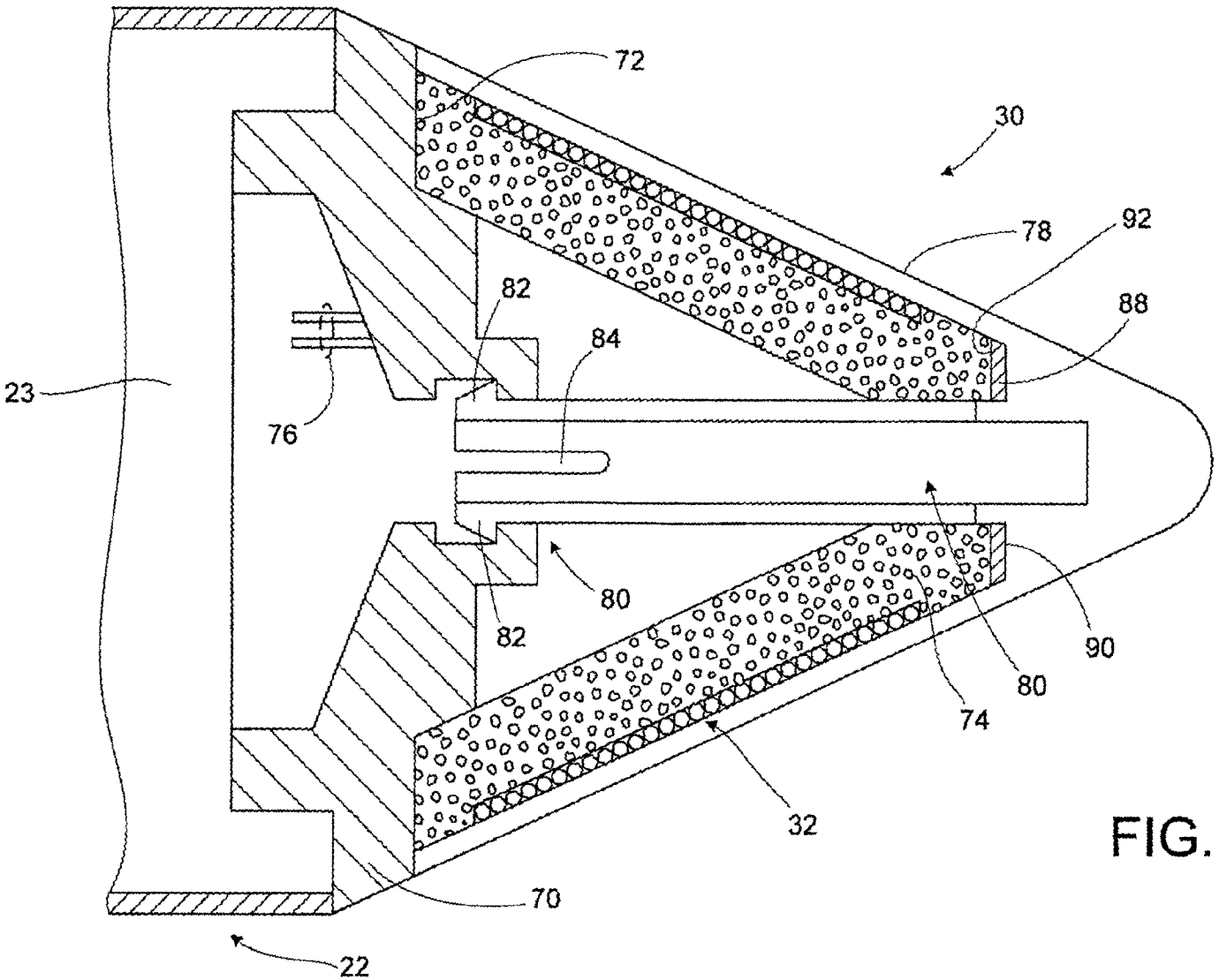
FIG. 4 is a full cross-sectional drawing of the relevant portion of the projectile shown in FIG. 3.

Referring to FIGS. 3 and 4, the inductive interface formed by the target coil 32 within the projectile 22 is illustrated in relevant cross section. As shown in FIGS. 3 and 4, the target coil 32 is located within the nose portion 30 of the projectile 22 in accordance with the exemplary embodiment. More specifically, an annular base 70 formed of machined aluminum or the like is provided at the forward end of the projectile 22 and serves as the base of the nose portion 30. The base 70 is bolted, welded, or otherwise secured to a cylindrical housing portion of the body 23.

The base 70 includes a lip 72 about its outer circumference, and seated against the lip 72 is a magnetic core 74 in accordance with an aspect of the invention. In the exemplary embodiment, the magnetic core 74 has a hollow conical shape. The base of the hollow cone shaped magnetic core 74 is seated against the lip 72. The target coil 32 comprises an electrical winding wound about the outer surface of the magnetic core 74 and coupled to the target electronics (not shown) within the body 23 via wires 76. FIG. 3 illustrates the coil 32 and magnetic core 74 in non-cross-section, whereas FIG. 4 illustrates the coil 32 and magnetic core 74 in cross-section as will be appreciated.

A radome 78 having a hollow conical shape conforming to that of the magnetic core 74 forms a cover which fits over the magnetic core 74 and coil 32. The radome 78 may be formed of conventional radome material such as plastic, etc. The radome 78 serves as a protective cover to the target coil 32 as well as any other interior equipment or electronics (e.g., seeker antenna, lens array, etc.). In addition, the radome 78 permits the transfer of electromagnetic energy therethrough, be it radar signals from within the projectile 22, or inductive energy between the target coil 32 and the setter coil 38.

As best illustrated in FIG. 4, the radome 78 includes a central cylindrical portion 80 having a diameter which may be inserted through a central opening at the top of the magnetic core 74. The central cylindrical portion 80 is hollow and includes protrusions 82 at the open end of the radome 78. The central cylindrical portion 80 includes axial slots 84 which permit the cylindrical portion 80 to collapse elastically so that the protrusions 82 may be snap fit into an aperture 86 within the base 70. A spring washer 88 is placed between a face 90 of the radome 78 and a face 92 of the magnetic core 74. As a result, the magnetic core 74 and target coil 32 may be held securely in the nose portion 30 of the projectile 22. The spring washer 88 prevents axial movement, whereas the central cylindrical portion 80 prevents radial movement. Moreover, the magnetic core 74, target coil 32 and radome 78 may be assembled as part of the body 23 with a simple snap fit.

Unlike prior art magnetic cores as used in projectiles, the magnetic core 74 in accordance with one aspect of the present invention is not simply an iron core or scintered ferrite core. Rather, the magnetic core 74 is made of a lightweight material, such as manganese-zinc or nickel-zinc ferrite filled plastic. The magnetic core 74 has high impact strength and therefore does not tend to crack, etc. as do typical magnetic cores of scintered ferrite material or the like. Moreover, the magnetic core 74 is lightweight compared to iron or conventional ferrite cores, thus providing significant weight savings. Furthermore, the core can be easily manufactured in complex shapes and sizes via molding, extrusion, machining, etc. This results in significantly lower manufacturing costs as will be appreciated.

In an exemplary embodiment, particles of high magnetic permeability material such as manganese-zinc ferrite or nickel-zinc ferrite are combined with a carrier material(s) such as Nylon No. 6. The carrier material may not have as high a magnetic permeability as manganese-zinc ferrite or nickel-zinc ferrite, but is significantly easier to machine, mold, extrude, etc. Thus, while there may be a trade-off in overall magnetic permeability of the magnetic core 74 as compared to iron or scintered ferrite, the magnetic core 74 is much more easily manufactured. Furthermore, the magnetic core 74 is significantly less brittle than a scintered core and far less likely to incur damage due to vibration, etc. In addition, the magnetic core 74 is significantly lighter in weight than an iron or scintered ferrite core.

According to one example, particles of manganese-zinc ferrite or nickel-zinc ferrite are combined with Nylon No. 6 stock. The combination is heated to a temperature exceeding the melting point of the Nylon No. 6 and stirred, thus creating an emulsion of suspended manganese-zinc ferrite or nickel-zinc ferrite particles within the plastic carrier medium. The emulsion may then be extruded and chopped to form the raw material (e.g., pellets). The raw material may be subsequently molded, machined, etc. in order to form the particular shape of the magnetic core 74. The ferrite particles remain impregnated within the Nylon, and serve to concentrate the magnetic flux lines induced therein via the target coil 32.

According to another example, ferrite materials other than manganese-zinc ferrite or nickel-zinc ferrite may be used. Similarly, other carrier materials, such as other types of plastics, may be used. For example, other types of thermoplastics may be used such as various commodity resins, polycarbonates, other nylons, liquid crystal polymers, polyphenylen sulfid, etc. The present invention contemplates any and all such combinations.

Preferably, the magnetic core 74 has a ferrite material content in the range of about 50% to about 90% by weight. More preferably, the magnetic core 74 has a ferrite material content in the range of about 70% to about 80% by weight: Furthermore, the magnetic core 74 preferably has a relative magnetic permeability in the range of about five to about fifteen. The present invention contemplates any and all such combinations.

Figure 5:
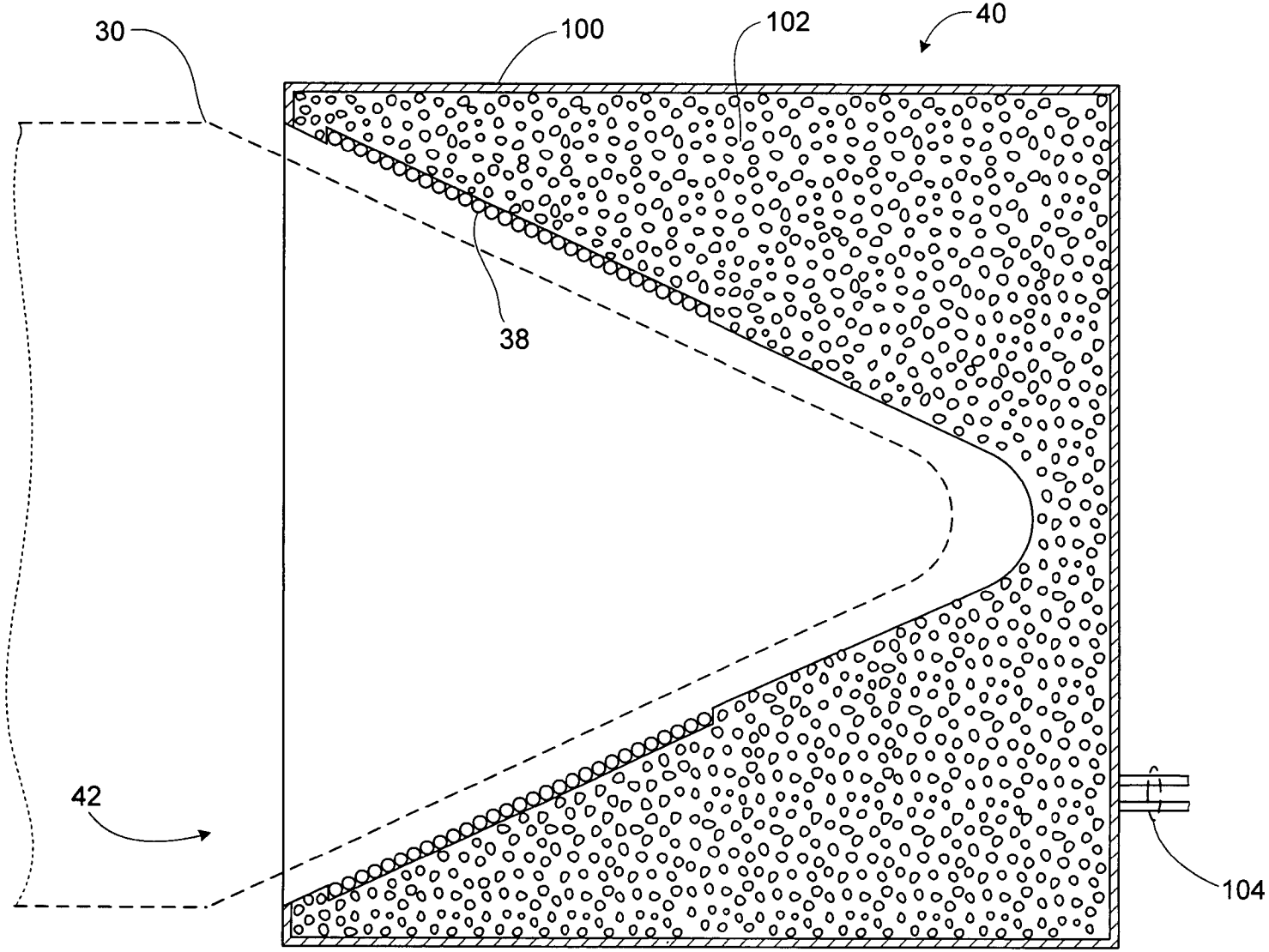
FIG. 5 is a cross-sectional drawing of a setter coil in accordance with an exemplary embodiment of the present invention.
Figure 6:
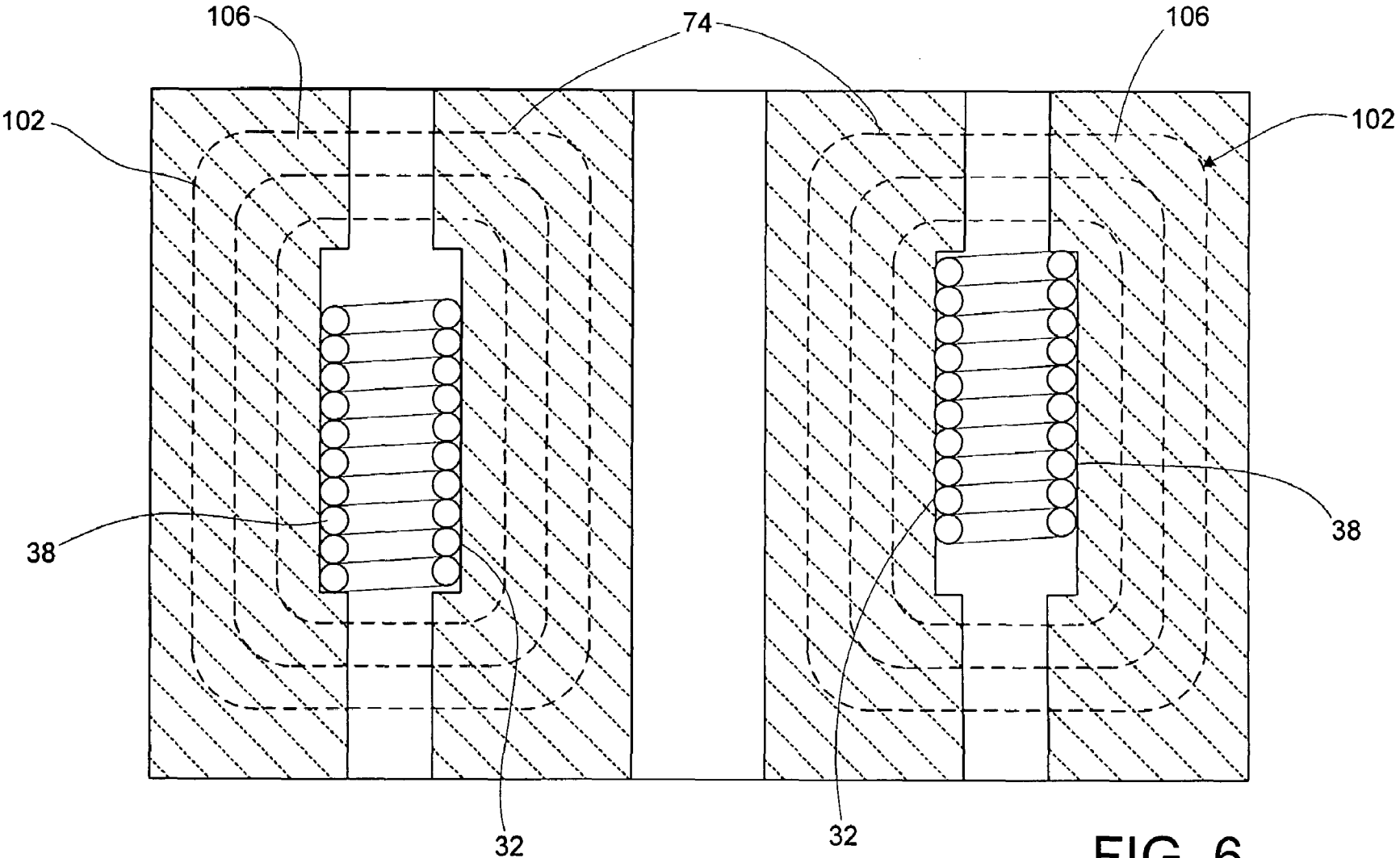
FIG. 6 is a schematic diagram illustrating the inductive coupling which occurs between the target coil and the setter coil in accordance with an exemplary embodiment of the present invention.

Turning briefly to FIG. 5, the nose portion adapter 40 of the setter system 24 is illustrated in cross-section. The nose portion adapter 40 includes a housing 100 which holds the setter coil 38. The setter coil 38 is wrapped around a magnetic core 102 which may be a conventional core or a core similar to the magnetic core 74 used in the projectile 22. The cavity 42 permits the nose portion 30 of the projectile 22 (shown in phantom) to be inserted into the nose portion adapter 40 so that the target coil 32 becomes aligned in close proximity to the setter coil 38. The setter coil 38 is coupled to the setter electronics 44 (not shown) via wires 104. FIG. 6 schematically represents how magnetic flux lines 106 are generated between the setter coil 38 and the target coil 32 when one or the other is energized. Such magnetic flux lines result in inductive coupling between the setter system 24 and the target system 36 when the the nose portion 30 is inserted into the nose portion adapter 40.

Figure 7A:
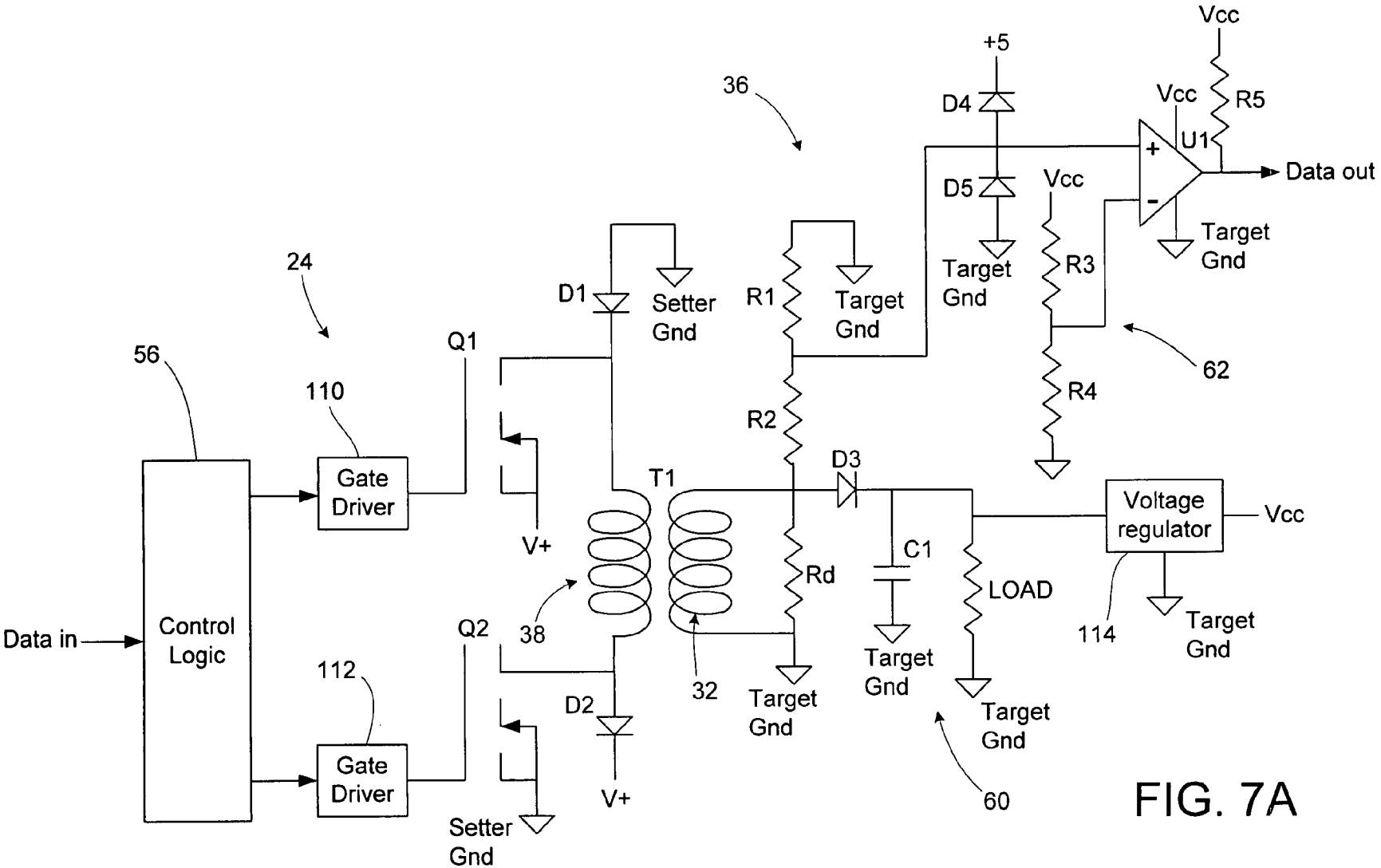
FIG. 7A is a circuit diagram of the setter system and target system in accordance with a first particular embodiment of the present invention.

FIG. 7A illustrates schematically an exemplary embodiment of the setter system 24 and target system 36. The setter system power driver 50 and data driver 52 (FIG. 2) are combined into one in this embodiment. The setter system 24 generates an idle waveform on the setter coil 38 when no data is present to transmit, for example a square wave. When data is present, the setter system 24 generates a bi-phase waveform on the setter coil 38 which contains the data to e transmitted. Because bi-phase is guaranteed to have at least one transistion per bit, the waveform will continue to transfer power.

Specifically, the setter system includes control logic 56 which controls V+gate driver 110 and Gnd gate driver 112 in opposite phase. Gate driver 110 controls power transistor Q1 for selectively providing voltage V+ to one end of the setter coil 38. Gate driver 112 controls power transistor Q2 for selectively providing voltage Gnd to the opposite end of the setter coil 38. A diode D1 is provided to tie the one end of the setter coil 38 to Gnd, and a diode D2 ties the other end of the sette coil 38 to voltage V+. By driving the transistors Q1 and Q2 in opposite phase, the voltage presented across the setter coil 38 varies between V+ and Gnd.

Figure 7B:
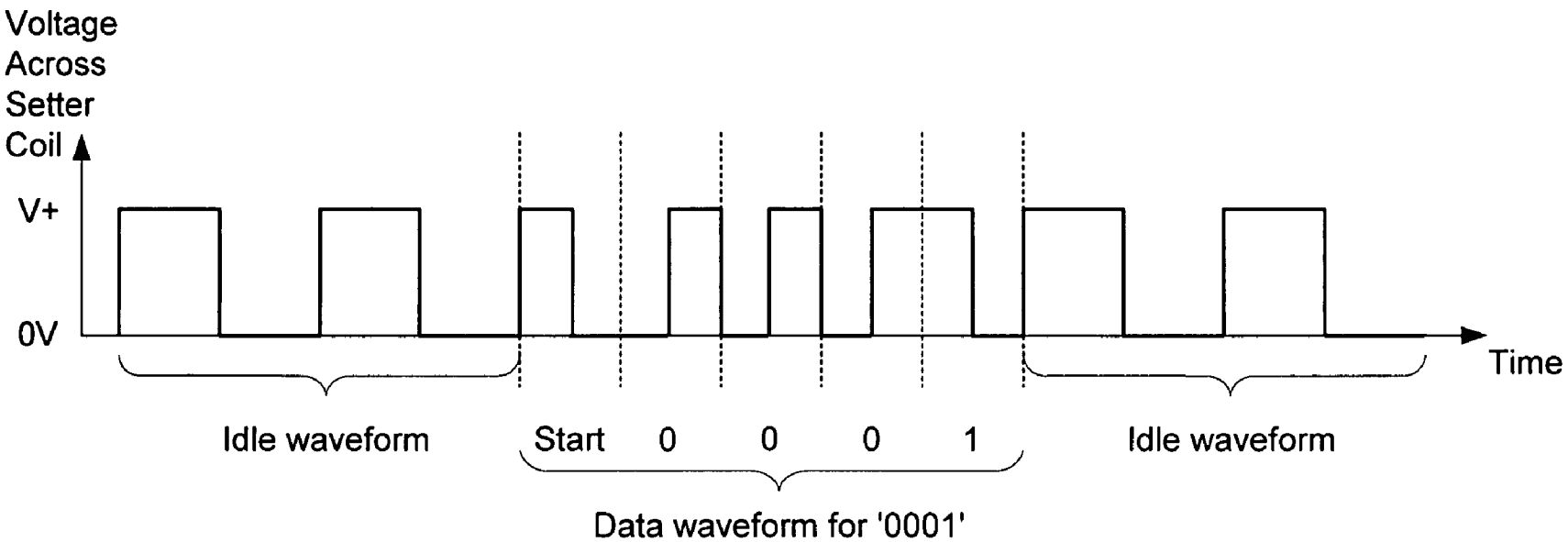
FIG. 7B is a waveform diagram exemplifying the transfer of power and data in accordance with the embodiment of FIG. 7A.

FIG. 7B illustrates an exemplary waveform across the setter coil 38. During an idle period where there is no data, the idle waveform (e.g., squarewave) is presented across the setter coil 38. During data transfer, a squarewave is bi-phase modulated in order to communicate data. The particular values of such data depends on the particular information to be transferred to the projectile 22 as will be appreciated.

Referring again to FIG. 7A, the target system 36 includes the target coil 32. The voltage across the setter coil 38 is induced across the target coil 32. A diode D3 serves to rectify the idle waveform as well as the data waveform across the target coil 32 so as to build up a DC charge across capacitor C1. The charge is coupled across a load resistor LOAD which represents any load circuitry included in the target electronics. A voltage regulator 114 utilizes the DC voltage across the resistor LOAD as an input voltage, and provides regulated DC power Vcc to the remaining target electronics within the projectile 22. In this manner, the setter system 24 is able to deliver power to the target system 36 via the target coil 32.

The target system 36 further includes a resistor divider comprising resistors R1, R2 and Rd. The resistor Rd is strapped across the target coil 32. As the voltage across the resistor Rd varies, the voltage at the node between resistors R1 and R2 varies. The voltage at the node between resistors R1 and R2 is input to a comparator U1. Diodes D4 and D5 are configured to limit the amplitude of the voltage input to the comparator U1. Resistors R3 and R4 are configured to provide a reference voltage to the other input of the comparator U1. Thus, the bi-phase modulated signal induced across the target coil 32 is output by the comparator U1 as a bi-phase modulated signal. Additional demodulation circuitry (not shown) included in the data receiver 62 can then demodulate the data and provide it to the control logic for carrying out the necessary operations within the projectile 22 as will be appreciated. In this manner, the setter system 24 is able to deliver data to the target system 36 using the same target coil 32.

Figure 8A:
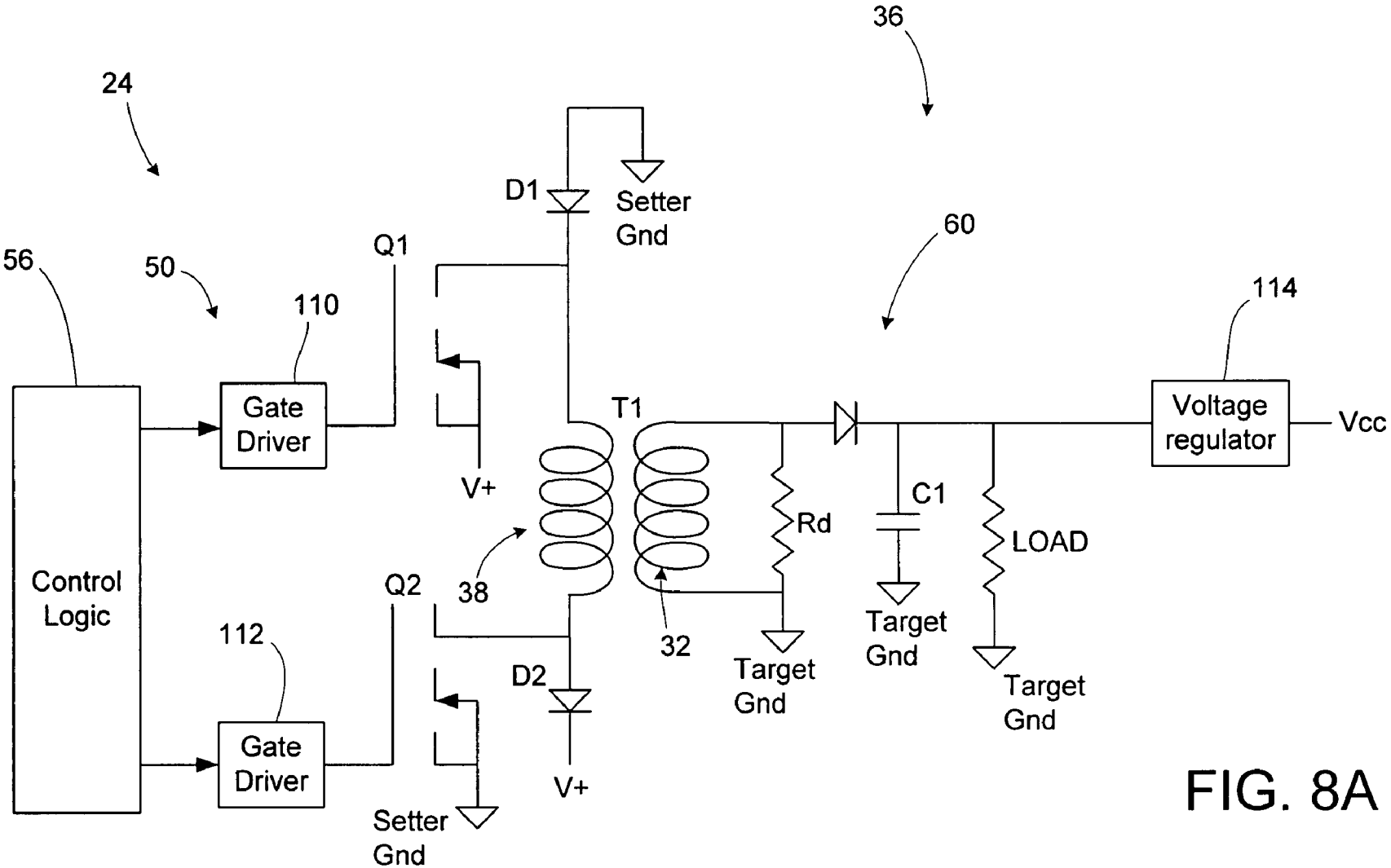
FIG. 8A is a circuit diagram of the setter system and target system power transfer circuitry in accordance with a different embodiment of the present invention.
Figure 8B:
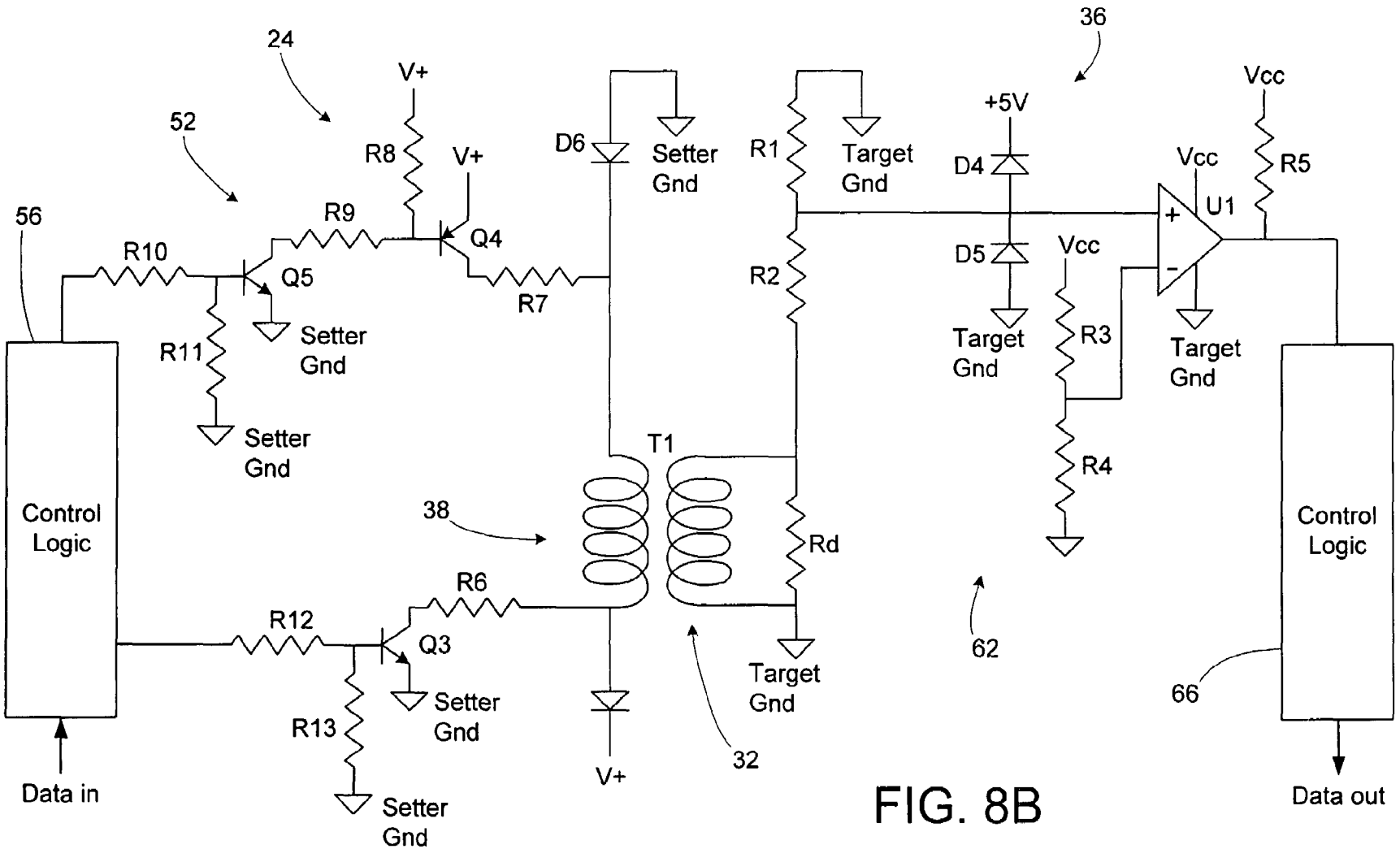
FIG. 8B is a circuit diagram of the setter system and target system data transfer circuitry in accordance with the embodiment of FIG. 8A.

FIGS. 8A and 8B illustrate schematically another embodiment of the setter system 24 and the target system 36. In this embodiment, the setter system 24 includes separate power driver and data driver circuits. FIG. 8A illustrates the relevant circuitry with respect to the power transfer aspect, and FIG. 8B illustrates the relevant circuitry with respect to the data transfer aspect.

In FIG. 8A, power is delivered and received via circuitry similar to that described above in relation to the embodiment of FIG. 7A. That is, the gate drivers 110 and 112 drive the transistors Q1 and Q2 in opposite phase so as to excite the setter coil 38 with a square wave when transferring power. The voltage induced across the target coil 32 is rectified and stored across the capacitor C1. The voltage regulator 114 then regulates the voltage to provide the voltage supply Vcc.

FIG. 8B illustrates circuitry for transferring data from the setter system 24 to the target system 36. In this embodiment, data is transferred during gaps in the power waveform. The gaps are large enough to allow the flux in the coils 32 and 38 to mostly or completely collapse and to allow data to be transmitted before the power waveform resumes. A capacitor or other charge storage device in the target system 36 provides power during the brief gap in the power waveform. As a consequence, the amplitude of the data waveform may be much lower than the power amplitude. This makes it more difficult for a third party to intercept sensitive data.

As shown in FIG. 8B, the data waveform is produced by driving bi-polar transistors Q3 and Q4 (via resistors R9–R13 and transistor Q5) in opposite phase and at lower amplitudes based on the data to be transmitted. The target system 36 receives and demodulates the data in the same manner described above with respect to the embodiment of FIG. 7A.

Figure 8C:
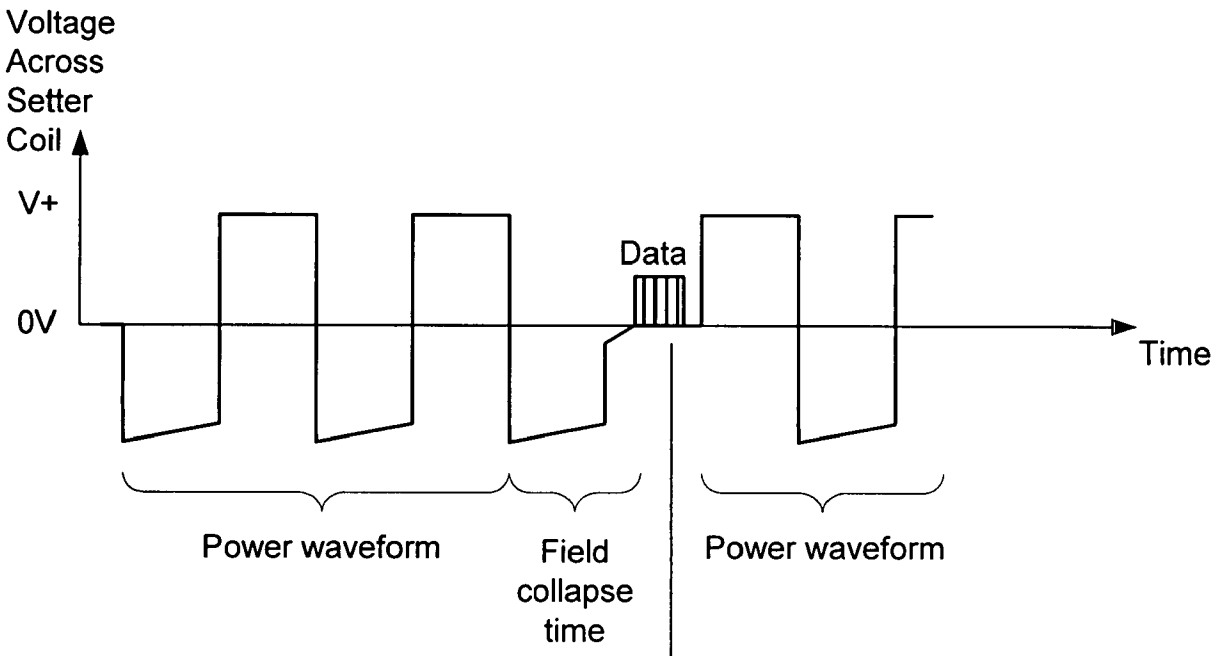
FIG. 8C is a waveform diagram exemplifying the transfer of power and data in accordance with the embodiment of FIGS. 8A and 8B.
Figure 8D:
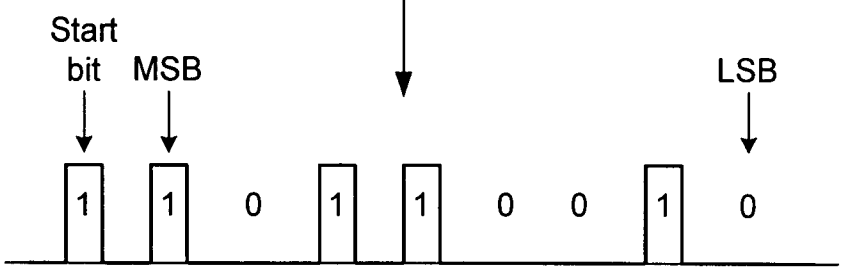
FIG. 8D is a detailed waveform diagram illustrating the data transfer in accordance with the embodiment of FIGS. 8A and 8B.

FIG. 8C shows an exemplary waveform of the voltage across the setter coil 38 according to the embodiment of FIGS. 8A and 8B. During the power waveform portion of the signal, the gate drivers 110, 112 and power transistors Q1 and Q2 excite the setter coil 38 to produce a square wave which is induced onto the target coil 32. The square wave is rectified and used to charge capacitor C1 and provide a voltage to the Load resistor and voltage regulator 114. During a field collapse time, the gate drivers 110 and 112 remain off and no voltage is placed across the setter coil 38. The magnetic fields then decay to so that the voltage across the setter coil 38 becomes substantially zero. Then, during a data period as represented in FIG. 8D, the data driver circuit 52 of the setter system 24 as represented in FIG. 8B modulates the data onto a data waveform across the setter coil 38 by turning on/off transistors Q3 and Q4. FIG. 8D illustrates an exemplary data waveform in more detail. Following the data waveform, the power waveform is repeated.

It will be appreciated that in an embodiment in which the target system 36 includes a data driver 64, the basic structure of the data driver 64 can be similar to that of the data driver 52 in the setter system 24. Similarly, the data receiver 54 of the setter system 24 can be configured similar to the data receiver 62 in the target system 36.

Although the invention has been shown and described with respect to certain preferred embodiments, it is obvious that equivalents and modifications will occur to others skilled in the art upon the reading and understanding of the specification. The present invention includes all such equivalents and modifications, and is limited only by the scope of the following claims.

What is claimed is:

1. A projectile, comprising:

a body;

a payload within the body;

a target system within the body for affecting operation of the projectile; and an inductive interface which, as part of the target system, permits transfer of power and data between the target system and an external setter system, the inductive interface comprising:

a magnetic core comprised of a compound of ferrite material and non-ferrite material; and a same coil wrapped around the magnetic core and which serves to transfer the power and data.

2. The projectile of claim 1, wherein the magnetic core has a ferrite material content in the range of about 50% to about 90% by weight.

3. The projectile of claim 2, wherein the magnetic core has a ferrite material content in the range of about 70% to about 80% by weight.

4. The projectile of claim 1, wherein the magnetic core comprises a plastic material impregnated with ferrite material.

5. The projectile of claim 4, wherein the plastic material is impregnated with manganese-zinc ferrite.

6. The projectile of claim 4, wherein the plastic material is impregnated with nickel-zinc ferrite.

7. The projectile of claim 4, wherein the plastic material comprises nylon.

8. The projectile of claim 4, wherein the plastic material is impregnated with at least one of manganese-zinc ferrite and nickel-zinc ferrite.

9. The projectile of claim 1, wherein the magnetic core is formed with an extruded material.

10. The projectile of claim 1, wherein the body comprises a conical nose portion, and the magnetic core has a hollow conical shape configured to fit within and follow a contour of the nose portion.

11. The projectile of claim 10, wherein the nose portion includes a central cylindrical portion along a central axis of the nose which fits within a hollow central portion of the magnetic core such that inner and outer surfaces of the magnetic core are maintained between walls of the nose portion.

12. The projectile of claim 11, wherein the central cylindrical portion includes a protrusion for engaging in a snap fit to secure the nose portion and magnetic core to a remainder of the body.

13. The projectile of claim 1, wherein a voltage waveform induced across the same coil comprises an idle waveform portion comprising energy for powering the target system, and a data waveform portion representing data sent to the target system.

14. The projectile of claim 13, wherein the idle waveform and the data waveform have substantially the same amplitude.

15. The projectile of claim 14, wherein the data waveform is also operative to provide energy for powering the target system.

16. The projectile of claim 1, wherein a voltage waveform induced across the same coil comprises a power waveform portion comprising energy for powering the target system, and a data waveform portion representing data sent to the target system, an amplitude of the data waveform portion being substantially smaller than an amplitude of the power waveform portion.

17. The projectile of claim 16, wherein the voltage waveform includes a field collapse portion between the power waveform portion and the data waveform portion.

* * * * *